US007375306B1

(12) United States Patent
Polley

(10) Patent No.: US 7,375,306 B1
(45) Date of Patent: May 20, 2008

(54) COOKING APPLIANCE HAVING MULTIPLE OPERATING CONFIGURATIONS

(75) Inventor: Nolan A. Polley, Ooltewah, TN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/636,770

(22) Filed: Dec. 11, 2006

(51) Int. Cl.

| | |
|---|---|
| ***H05B 3/02*** | (2006.01) |
| ***A21B 1/02*** | (2006.01) |
| ***A21B 1/40*** | (2006.01) |
| ***F24C 7/00*** | (2006.01) |

(52) U.S. Cl. ..... 219/391; 219/412; 219/477; 219/483

(58) Field of Classification Search ..... None
See application file for complete search history.

(56) References Cited

U.S. PATENT DOCUMENTS

| | | | | |
|---|---|---|---|---|
| 2,515,427 | A * | 7/1950 | Schulze | 219/412 |
| 3,364,338 | A * | 1/1968 | Holtkamp | 219/412 |
| 4,002,112 | A | 1/1977 | Snyder | |
| 4,623,781 | A * | 11/1986 | Thomas | 219/483 |
| 5,043,860 | A | 8/1991 | Koether et al. | |
| 5,638,808 | A | 6/1997 | Home | |
| 6,093,914 | A * | 7/2000 | Diekmann et al. | 219/483 |
| 6,289,793 | B1 | 9/2001 | Hu et al. | |
| 6,394,640 | B1 | 5/2002 | Astegno et al. | |
| 6,830,045 | B2 | 12/2004 | Brock et al. | |
| 6,966,315 | B2 | 11/2005 | Pickering | |

* cited by examiner

*Primary Examiner*—J. Pelham
(74) *Attorney, Agent, or Firm*—George L. Rideout, Esq.; Armstrong Teasdale LLP

(57) ABSTRACT

A cooking appliance is provided. The cooking appliance is coupled to a power supply that includes a first hot wire, a second hot wire and a ground wire. The cooking appliance includes a cabinet and a cavity defined within the cabinet. The cooking appliance also includes at least one heating assembly having two electrical heating elements positioned with respect to the cavity. A first electrical heating element is electrically coupled to the first hot wire and the ground wire. A second electrical heating element is electrically coupled to the second hot wire and the ground wire.

20 Claims, 1 Drawing Sheet

COOKING APPLIANCE HAVING MULTIPLE OPERATING CONFIGURATIONS

BACKGROUND OF THE INVENTION

This invention relates generally to cooking appliances and, more particularly, to a cooking appliance having multiple operating configurations.

Some known cooking appliances include an oven cavity and electrical heating elements, such as a baking element and/or a broiling element, positioned within the oven cavity for heating food items positioned within the oven cavity. The cooking appliances are generally installed in a kitchen area of a building and coupled to the building's electrical power supply.

Many single family residential buildings include an electrical power supply system that includes three wires for supplying electrical power at 240 volts (on a 120/240V circuit). The power supply system includes two hot wires and a neutral wire. In such power supply systems, the voltage between the two hot wires is about 240 volts and the voltage between each hot wire and the neutral wire is about 120 volts. In contrast, many multiple family residential buildings, such as high-rise residential apartment buildings, include an electrical power supply system that supplies electrical power at about 208 volts (on a 120/208V circuit). In such power supply systems, the voltage between the two hot wires is about 208 volts and the voltage between each hot wire and the neutral wire is about 120 volts.

Conventional cooking appliances are typically configured to operate efficiently on a 120/240V circuit found in many single family residential buildings. As a result, when such conventional cooking appliances are coupled to a 120/208V circuit, such as found in many multiple family residential buildings, a power output of the heating elements is reduced, which may compromise appliance performance. The reduction in power output undesirably results in longer preheating times and/or inconsistent cooking performance.

BRIEF DESCRIPTION OF THE INVENTION

In one aspect, an oven coupled to a power supply including a first hot wire, a second hot wire and a neutral wire is provided. The oven includes a cabinet and a cavity defined within the cabinet. The oven also includes at least one heating assembly mounted with respect to the cavity and including two electrical heating elements. A first electrical heating element of the two electrical heating elements is electrically coupled to the first hot wire and the neutral wire. A second electrical heating element of the two electrical heating elements is electrically coupled to the second hot wire and the neutral wire.

In another aspect, a cooking appliance coupled to a power supply including a first hot wire, a second hot wire and a ground wire is provided. The cooking appliance includes a cabinet and a cavity defined within the cabinet. The cooking appliance also includes at least one heating assembly including two electrical heating elements positioned with respect to the cavity. A first electrical heating element of the two electrical heating elements is electrically coupled to the first hot wire and the ground wire. A second electrical heating element of the two electrical heating elements is electrically coupled to the second hot wire and the ground wire.

In still another aspect, a method is provided for assembling a cooking appliance coupled to an alternating current power supply including a first hot wire, a second hot wire and a neutral wire. The method includes providing a cooking appliance including a cabinet defining a cavity. At least one heating assembly is mounted with respect to the cavity. The at least one heating assembly includes at least two electrical heating elements. A first electrical heating element of the at least two electrical heating elements is electrically coupled to the first hot wire and the neutral wire. A second electrical heating element of the at least two electrical heating elements is electrically coupled to the second hot wire and the neutral wire.

DETAILED DESCRIPTION OF THE INVENTION

Figure 1:
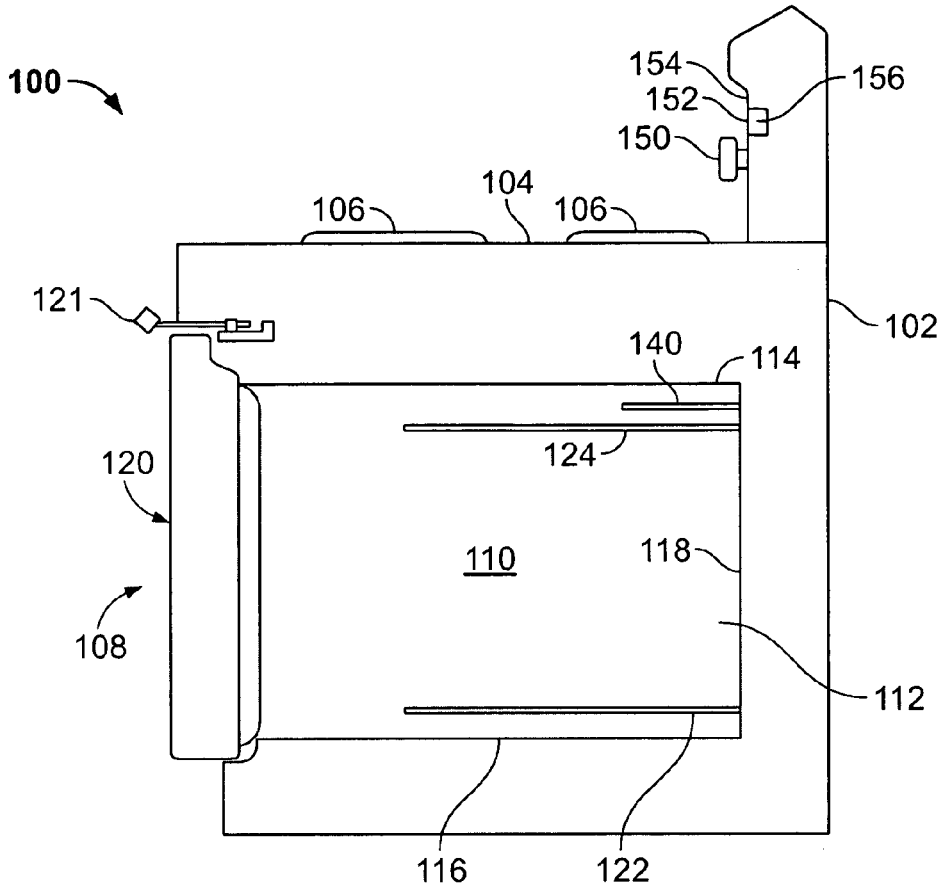
FIG. 1 is a sectional view of an exemplary electric cooking appliance having an oven.

FIG. 1 illustrates an exemplary electric cooking appliance in the form of a free standing electric range 100 suitable for the present invention. Range 100 includes an outer cabinet 102 with a top cooking surface 104 having individual surface heating elements 106. Range 100 further includes an oven 108 positioned below cooking surface 104 and defining a cavity 110.

The present invention is described below in reference to its application in connection with and operation of electric range 100. However, it will be apparent to those skilled in the art and guided by the teachings herein provided that the invention is likewise applicable to any electric household appliance including, without limitation, free standing cooktops, duel cooking appliances, speedcooking ovens and wall ovens.

As shown in FIG. 1, cavity 110 is at least partially defined by a box-like oven liner including generally vertical side walls 112, a top wall 114 coupled to each side wall 112, a bottom wall 116 coupled to each side wall 112, a rear wall 118 coupled to side walls 112, top wall 114 and bottom wall 116, and a front opening door 120. As shown in FIG. 1, a latch 121 is coupled to cabinet 102 and configured to lock door 120 in a closed position during a self-cleaning operation, for example.

In one embodiment, at least one heating assembly, such as a bake assembly, a broil assembly and/or a convection assembly, is mounted with respect to cavity 110. As shown in FIG. 1, a bake assembly 122 is mounted within cavity 110 at or near bottom wall 116 and a broil assembly 124 is mounted within cavity 110 at or near top wall 114. In an alternative embodiment, bake assembly 122 is mounted within cabinet 102 and underneath cavity 110 at or near bottom wall 116 (i.e., not within cavity 110) such that bake assembly 122 is configured to heat cavity 110. Bake assembly 122 includes a first electrical heating element 126 and a second electrical heating element 128 (shown schematically in FIG. 2). Similarly, broil assembly 124 includes a first electrical heating element 130 and a second electrical heating element 132 (shown schematically in FIG. 2). In an alternative embodiment, a convection assembly (not shown) including a first electrical heating element and a second electrical heating element is positioned within cavity 110.

A temperature sensor 140 is mounted at least partially within cavity 110 and configured to sense a temperature within cavity 110. In one embodiment, sensor 140 is positioned between broil assembly 124 and top wall 114. It is apparent to those skilled in the art that sensor 140 may be positioned in any suitable location within cavity 110, such as between broil assembly 124 and bake assembly 122, and/or any suitable number of sensors 140 may be used to monitor the temperature within cavity 110.

As shown in FIG. 1, a control knob 150 is mounted to a control panel 152, which is supported by a back splash 154 of range 100. Control panel 152 includes a controller 156 operatively coupled to control knob 150 and configured to control the operation of range 100 and/or oven 108 according to cooking features selected by the operator. Controller 156 is operatively coupled to sensor 140 for receiving signals representative of the detected cavity temperature from sensor 140. Additionally, controller 156 is operatively coupled to bake assembly 122 and/or broil assembly 124 and/or the convection assembly for facilitating controlling the operation of bake assembly 122 and/or broil assembly 124 and/or the convection assembly.

Figure 2:
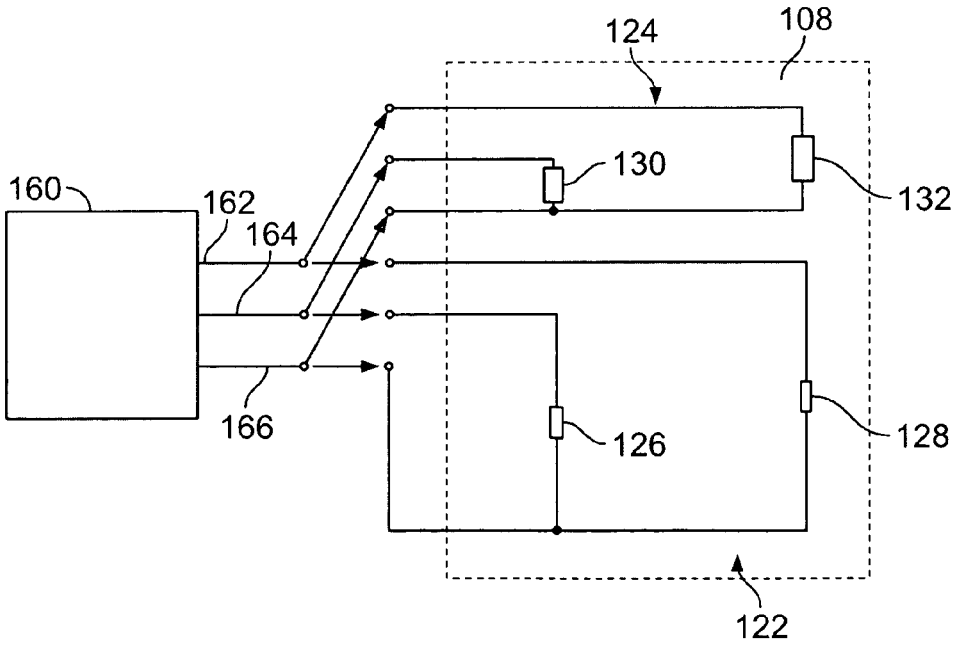
FIG. 2 is a schematic view of the cooking appliance shown in FIG. 1 coupled to an exemplary electrical power supply.

FIG. 2 is a schematic view of range 100 shown in FIG. 1 coupled to an electric power supply 160. In one embodiment, bake assembly 122 includes first electrical heating element 126 and second electrical heating element 128 that are supplied with electric power on a 120V circuit. Further, heating elements 126, 128 have the same or similar electrical resistance. Thus, a power output of first heating element 126 is substantially similar to a power output of second heating element 128. In a particular embodiment, each heating element 126, 128 has a resistance of about 7.2 Ohms. In this embodiment, when coupled to a 120V circuit, each heating element 126, 128 provides 2,000 Watts (W) of electric power. In this embodiment, with each heating element 126, 128 providing about 2,000 W of electrical power, a total of 4,000 W of electrical power is provided to heat cavity 110. In an alternative embodiment, first heating element 126 provides an amount of electrical power different from an amount of electrical power provided by second heating element 128.

In one embodiment, alternating current power supply 160 is configured to provide electric power to electrical components of range 100, such as for example, electric bake assembly 122 and/or electric broil assembly 124. Power supply 160 includes two hot wires 162, 164 and a neutral wire 166. The voltage between hot wires 162, 164 is about 208V when power supply 160 is a 208V power supply, and the voltage between hot wires 162, 164 is about 240V when power supply 160 is a 240V power supply. The voltage between hot wire 162 and neutral wire 166 and the voltage between hot wire 164 and neutral wire 166 is about 120V. In a particular embodiment, neutral wire 166 is grounded, and is referred to as ground wire.

In operation, first heating element 126 and second heating element 128 are electrically coupled to power supply 160. Controller 156 is operatively coupled to each heating element 126, 128 and configured to control the power supplied to first heating element 126 and/or second heating element 128. In one embodiment, controller 156 simultaneously energizes or de-energizes heating elements 126, 128 to bake food items positioned within cavity 110. In a particular embodiment, first heating element 126 is electrically coupled to hot wire 164 and neutral wire 166 and second heating element 128 is electrically coupled to hot wire 162 and neutral wire 166. As described above, the voltage between hot wire 162 and neutral wire 166 and the voltage between hot wire 164 and neutral wire 166 is about 120V, whether power supply 160 is a 208V power supply or a 240V power supply. As such, a voltage of about 120V is applied to each heating element 126, 128 independently of whether the voltage between hot wires 162, 164 is 208V or 240V. Heating elements 126, 128 facilitate providing a substantially equal power output independent from the voltage between hot wires 162, 164.

Similarly, power supply 160 is configured to provide electric power to electric broil assembly 124. Broil assembly 124 includes first heating element 130 and second heating element 132 electrically coupled to power supply 160. Controller 156 is operatively coupled to each heating element 130, 132 and configured to control the power supplied to first heating element 130 and/or second heating element 132. In one embodiment, controller 156 simultaneously energizes or de-energizes heating elements 130, 132 to broil food items positioned within cavity 110. In a particular embodiment, first heating element 130 is electrically coupled to hot wire 164 and neutral wire 166 and second heating element 132 is electrically coupled to hot wire 162 and neutral wire 166. As described above, the voltage between hot wire 162 and neutral wire 166 and the voltage between hot wire 164 and neutral wire 166 is about 120V, whether power supply 160 is a 208V power supply or a 240V power supply. As such, a voltage of about 120V is applied to each heating element 130, 132 independently of whether the voltage between hot wires 162, 164 is 208V or 240V. Heating elements 130, 132 facilitate providing a substantially equal power output independent from the voltage between hot wires 162, 164.

In an alternative embodiment, the convention assembly (not shown) also includes two electrical heating elements electrically coupled to power supply 160 in a similar way as heating elements 126, 128 and/or heating elements 130, 132 are electrically coupled to power supply 160, as described above. In one embodiment, controller 156 selectively energizes the heating elements of bake assembly 122 and/or broil assembly 124 and/or the convention assembly based on the temperature detected by sensor 140 positioned within cavity 110. As such, a desired power output, such as a power output of about 4,000 W, can be provided to oven 108 regardless of whether power supply 160 is a 208V power supply or a 240V power supply.

The above-described apparatus for providing electric power to a plurality of cooking assemblies within an oven allows efficient and optimal cooking performance at multiple operating configurations. More specifically, each cooking assembly includes two heating elements each independently electrically coupled between one hot wire and a neutral wire of an electric power supply. As a result, a desired power output is provided when the cooking appliance is coupled to a 120/240V circuit or a 120/208V to achieve consistent appliance performance.

Exemplary embodiments of an apparatus and method for providing electrical power to a plurality of cooking assemblies are described above in detail. The apparatus and method is not limited to the specific embodiments described herein, but rather components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and/or method as described herein.

While the invention has been described in terms of various specific embodiments, those skilled in the art will recognize that the invention can be practiced with modification within the spirit and scope of the claims.

What is claimed is:

1. An oven coupled to a power supply including a first hot wire, a second hot wire and a neutral wire, said oven comprising:

a cabinet;

a cavity defined within said cabinet; and at least one heating assembly mounted with respect to said cavity and including two electrical heating elements, a first electrical heating element of said two electrical heating elements electrically coupled to the first hot wire and the neutral wire, a second electrical heating element of said two electrical heating elements electrically coupled to the second hot wire and the neutral wire.

2. An oven in accordance with claim 1 wherein said electrical heating elements are configured to be energized simultaneously.

3. An oven in accordance with claim 1 wherein said at least one heating assembly comprises at least one of a bake assembly, a broil assembly and a convection assembly.

4. An oven in accordance with claim 1 wherein said electrical heating elements are configured to provide a substantially equal power output independent from the voltage between the first hot wire and the second hot wire.

5. An oven in accordance with claim 4 wherein the voltage between the first hot wire and the second hot wire is one of about 208 volts and about 240 volts.

6. An oven in accordance with claim 1 wherein said first electrical heating element and said second electrical heating element each is configured to operate at about 120 volts.

7. An oven in accordance with claim 1 wherein said first heating element and said second heating element each is configured to operate in alternating current.

8. A cooking appliance coupled to a power supply including a first hot wire, a second hot wire and a ground wire, said cooking appliance comprising:

a cabinet;

a cavity defined within said cabinet; and at least one heating assembly including two electrical heating elements positioned with respect to said cavity, a first electrical heating element of said two electrical heating elements electrically coupled to the first hot wire and the ground wire, a second electrical heating element of said two electrical heating elements electrically coupled to the second hot wire and the ground wire.

9. A cooking appliance in accordance with claim 8 wherein said two electrical heating elements are configured to operate simultaneously.

10. A cooking appliance in accordance with claim 8 wherein said at least one heating assembly comprises at least one of a bake assembly, a broil assembly and a convection assembly.

11. A cooking appliance in accordance with claim 8 wherein said two electrical heating elements are configured to provide a substantially equal power output independent from the voltage between the first hot wire and the second hot wire.

12. A cooking appliance in accordance with claim 11 wherein the voltage between the first hot wire and the second hot wire is one of about 208 volts and about 240 volts.

13. A cooking appliance in accordance with claim 8 wherein a voltage of about 120 volts is applied to each of said first electrical heating element and said second electrical heating element.

14. A cooking appliance in accordance with claim 8 wherein said cooking appliance comprises an oven.

15. A method for assembling a cooking appliance coupled to an alternating current power supply including a first hot wire, a second hot wire and a neutral wire, said method comprising:

providing a cooking appliance including a cabinet defining a cavity; and mounting at least one heating assembly with respect to the cavity, the at least one heating assembly comprising at least two electrical heating elements, a first electrical heating element of the at least two electrical heating elements electrically coupled to the first hot wire and the neutral wire, a second electrical heating element of the at least two electrical heating elements electrically coupled to the second hot wire and the neutral wire.

16. A method in accordance with claim 15 further comprising operatively coupling each heating assembly to a controller configured to selectively operate the electrical heating elements simultaneously.

17. A method in accordance with claim 15 wherein mounting at least one heating assembly further comprises mounting at least one of an electrical bake assembly, an electrical broil assembly and an electrical convection assembly within the cavity.

18. A method in accordance with claim 15 further comprising mounting the at least one heating assembly such that the at least two electrical heating elements are configured to provide a substantially equal power output independent from the voltage between the first hot wire and the second hot wire.

19. A method in accordance with claim 18 further comprising mounting the at least one heating assembly such that the at least two electrical heating elements are configured to provide a substantially equal power output when the voltage between the first hot wire and the second hot wire is one of about 208 volts and about 240 volts.

20. A method in accordance with claim 15 further comprising mounting the at least one heating assembly such that the at least two electrical heating elements are configured to operate in alternating current.

* * * * *